United States Patent [19]

Hoffmann

[11] 4,297,090

[45] Oct. 27, 1981

[54] ROTARY EXPANSION POWER UNIT WITH VALVE DISC CONNECTED TO CRANKSHAFT

[75] Inventor: Ralph M. Hoffmann, Eden Prairie, Minn.

[73] Assignee: Trochoid Power Corporation, Eden Prairie, Minn.

[21] Appl. No.: 89,220

[22] Filed: Oct. 29, 1979

[51] Int. Cl.[3] ..... F01C 1/22; F01C 19/00; F01C 21/12

[52] U.S. Cl. ..... 418/61 A; 418/94; 418/104; 418/142; 418/183

[58] Field of Search ..... 418/61 A, 91, 94, 104, 418/142, 183, 186, 61 B

[56] References Cited

U.S. PATENT DOCUMENTS

| | | | |
|---|---|---|---|
| 2,871,831 | 2/1959 | Patin | 418/61 B |
| 3,323,712 | 6/1967 | Froede et al. | 418/61 A |
| 3,369,740 | 2/1968 | Abermeth | 418/61 A |
| 3,781,147 | 12/1973 | Sato | 418/104 |
| 3,881,847 | 5/1975 | Chen | 418/61 A |
| 4,047,856 | 9/1977 | Hoffman | 418/61 A |

FOREIGN PATENT DOCUMENTS

| | | | |
|---|---|---|---|
| 2700233 | 7/1978 | Fed. Rep. of Germany | 418/142 |

*Primary Examiner*—John J. Vrablik

*Attorney, Agent, or Firm*—Hill, Van Santen, Steadman, Chiara & Simpson

[57] ABSTRACT

A rotary expansion power unit, such as a steam engine, which has a planetating rotor in a housing having an epitrochoidal cavity. In known engines, hot expansion fluid is directed through a hollow interior in the rotor and surrounds the rotor journal bearing. This leads to excessive expansion of the rotor and requires an excessive flow of cooling oil to the bearing. The invention isolates the expansion fluid from the interior of the rotor by having a valve disc fastened to the rotor crankshaft with a first seal means between the valve disc and housing end wall and a second seal means between the valve disc and rotor.

13 Claims, 4 Drawing Figures

ROTARY EXPANSION POWER UNIT WITH VALVE DISC CONNECTED TO CRANKSHAFT

BACKGROUND OF THE INVENTION

This invention relates generally to a rotary expansion steam power unit of the type having a planetating rotor, and more particularly, to an improvement in the means for providing the expansion fluid to the expansion chambers in such a unit. Such improvement includes, among other things, means for isolating the main shaft and working bearings of the engine from such hot expansion fluid.

Rotary expansion engines of the type having a housing defining a plurality of epitrochoidal cavities, a rotor element movable within said cavities, and eccentric means including a crank shaft on which the rotor rotates are well known in the art. These engines also include appropriate seals and valving means for selectively directing expansion fluid into the plurality of expansion chambers defined by the engine housing and the outer surfaces of the rotor. A typical rotary expansion engine of this type is described in Hoffmann U.S. Pat. No. 4,047,856.

In rotary expansion engines generally, including the engine described in U.S. Pat. No. 4,047,856, it has been found that the interior of the rotor member provides a convenient inventory for the expansion fluid. This expansion fluid is then selectively released to the respective expansion chambers by various valve means. As an example, the expansion fluid may be released into the respective expansion chambers by passage of the rotor circular side seals over various contoured valving cavities positioned in the end walls of the engine housing. In constructions such as this, the rotor journal bearing is surrounded with hot expansion fluid such as steam. This requires such bearings to be provided with an otherwise excessive flow of cooling oil necessary to keep the bearing from failing due to excessive heat. Also, when the hot expansion fluid is allowed to enter the interior of the rotor, the rotor attains high heat due to its being internally bathed in the hot expansion fluid, thus leading to excessive expansion and loss of dimensional control.

Thus, there is a need for a rotary expansion engine having means for isolating the hot expansion fluid from the main shaft, the shaft support bearings and the phasing gears and for providing lubrication and cooling oil thereto.

SUMMARY OF THE INVENTION

In contrast to the prior art, the present invention avoids the problems referred to above by providing an improved eccentric construction having a pair of steam or valve discs secured to opposite end walls of the eccentric to isolate the journal bearings and the interior of the rotor element from the incoming expansion fluid. To accomplish such isolation, each of the steam or valve discs includes a pair of generally circular sealing members. One of the sealing members is disposed between an outer surface or portion of the steam disc and an end wall of the engine housing; the second sealing member is positioned between a portion of the steam disc and the rotor element. The first of these sealing members is generally concentric with the main shaft of the engine while the second is concentric with the axial center line of the eccentric. A third, generally conventional circular face seal or working seal is also included. This third working seal is disposed between a portion of the valve disc or rotor element and the housing end wall to periodically admit expansion fluid to the expansion chambers. This working seal is generally concentric with the axial center line of the eccentric. An annular steam passageway is also formed in each of the steam or valve discs for directing the expansion fluid or steam from the inlet to the respective expansion chambers and to provide an inventory or reservoir of steam as near as possible to the expansion chambers.

Means are also provided in the rotary expansion engine of the present invention for supplying lubricating and cooling oil to the various journal bearings, phasing gears and other moving parts within the engine. In the preferred embodiment, this means includes oil holes extending axially through the interior of the main engine shaft and radially extending holes for providing lubricating fluid from the axial hole to the bearings, etc. Such lubricating oil acts as a coolant since, after it exits from the engine, it is usually cooled by external means and re-circulated, thus cooling as well as lubricating the bearings, gears, etc.

It has also been found that if the seal members described above are slightly eccentric with respect to their center axis of rotation, improved wiping of oil in the sealing surfaces is attained and thus longer seal life.

Thus, with the construction of the rotary expansion engine of the present invention, as will be described in more detail below, the improved eccentric having such steam or valve discs allows the interior of the rotor and related bearings and gears to be isolated from the hot expansion fluid and flooded with relatively cool lubricating fluid rather than hot expansion fluid, thus keeping the rotor cool and reducing its tendency to otherwise expand. Keeping the rotor cooler also allows for it to be made of less expansive metals, such as aluminum instead of cast iron, thus reducing the moment of inertia of the engine and increasing its ability to accelerate and decreasing the amount of power needed to brake it to a stop.

In addition, flow of oil to the rotor journal bearing is reduced, thus allowing a smaller oil pump requiring less power to operate than is otherwise necessary. This in turn increases the power output of the expansion engine by a like amount. Further, since less oil needs to be cooled less, after passing through the journal bearings, it is apparent that the resultant oil cooler is now smaller than otherwise necessary, thus reducing the weight of the total system by a like amount. Also, because the oil cooler is generally cooled by the boiler water, the invention requires less water to be pumped through the cooler resulting in a smaller water pump requiring less power to operate and also less weight. This increases the power output of the engine and decreases the weight of the system by a like amount.

Accordingly, an object of the present invention is to provide an improved rotary expansion engine having means for improving the lubrication of the main journal bearings, phasing gears and other moving parts in the engine.

Another object of the present invention is to provide a rotary expansion engine having means for preventing expansion fluid from entering the interior of the rotor element.

A further object of the present invention is to provide a rotary expansion engine having an improved eccentric with means for isolating the incoming expansion fluid from the rotor bearings and gears and the interior of the rotor cavity.

Another object of the present invention is to provide a rotary expansion engine with an improved eccentric element including a pair of steam or valve discs on opposite sides thereof and each disc having a pair of seal members concentric with the main engine shaft for isolating the main journal bearings and phasing gears from the incoming expansion fluid.

Another object is to reduce the weight of the engine system and to increase its efficiency by reducing size and weight of the attendant oil lubricating and cooling system otherwise required.

These and other objects of the present invention will become apparent with reference to the drawings, the description of the preferred embodiment and the appended claims.

DESCRIPTION OF THE PREFERRED EMBODIMENT

Figures 1, 2:
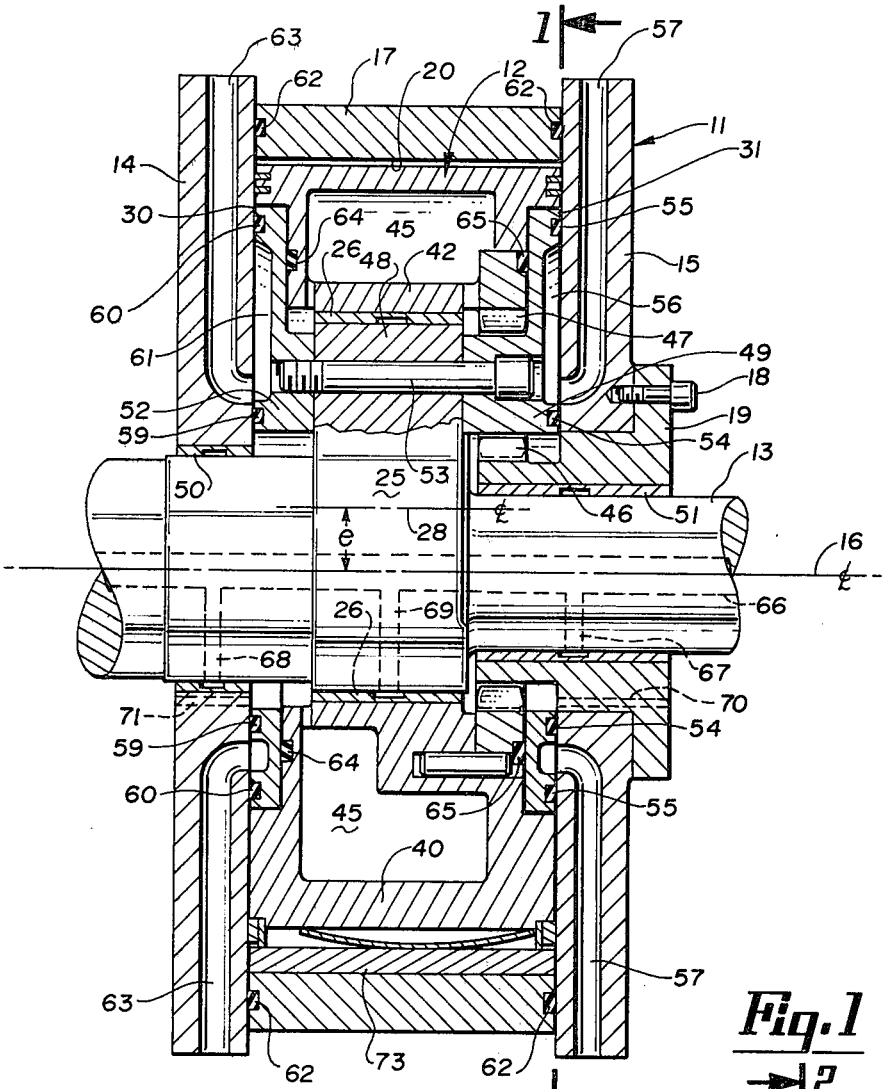
FIG. 1 is a plan view of the rotary expansion engine of the present invention as seen axially, with an end wall removed for clarity of illustration.
FIG. 2 is a sectional view of the rotary expansion engine of the present invention as viewed along the line 2—2 of FIG. 1.

As shown in FIGS. 1 and 2, the rotary expansion engine of the present invention comprises a housing 11, a rotor 12 and a crank shaft 13. The housing 11 comprises a pair of opposite end walls 14 and 15 which are axially spaced from each other along the axis 16 of the crank shaft 13. Each of the walls 14 and 15 includes a steam inlet 63 and 57, respectively. The housing also includes a peripheral wall 17 positioned between the side walls 14 and 15 near their outer edges to define a cavity 20 which is symmetrical with the axis 16. As illustrated best in FIG. 1, the cavity 20 includes a pair of epitrochoidal lobes 21 and 22 which intersect at a pair of lobe junctions 23 and 24 to define the minor axis of the housing. A pair of "O" rings 62, 62 (FIG. 2) or other sealing means such as a gasket are disposed between the housing side walls 14 and 15 and the edges of the peripheral wall 17 to seal the cavity 20.

The crank shaft 13 is rotatably mounted at one end in the bearing housing 19 which in turn is secured to the side wall 15 by bolts 18 or other appropriate connecting means. A sleeve bearing 51 is disposed between the rotating shaft 13 and the stationary bearing housing 19. The other end of the crank shaft 13 is rotatably mounted with respect to the side wall 14 by the sleeve bearing 50.

Figure 3:
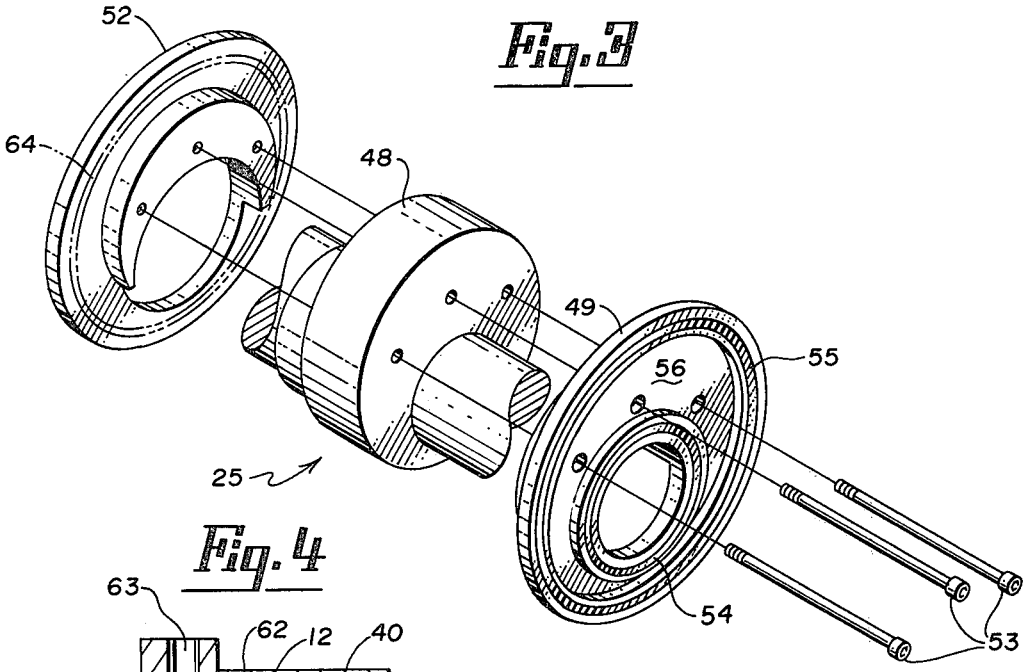
FIG. 3 is a pictorial view of the eccentric means showing the crankshaft, the steam or valve disc portions and related seals.

As illustrated best in FIGS. 2 and 3, the crank shaft 13 includes an eccentric member 25 which includes a generally cylindrical center portion 48, such portion being circular in traverse section. The eccentric 25 is concentric about the axis 28. The outer cylindrical surface of the center portion 48 is rotatably mounted within the rotor 12 via the annular sleeve bearing 26. As will be described in more detail below, the eccentric 25 also includes a pair of steam or valve discs 49 and 52 on opposite sides of the center portion for isolating the cavities within the rotor from the hot expansion fluid. These valve discs are separated axially by, and fastened to, the eccentric 25 such that the rotor 12 is not clamped, but is free to rotate because it does not contact the valve discs 49 and 52.

The rotor 12 is symmetrical about the axis 28 of the bearing member 26 and the eccentric 25; hence, the center line 28 of the rotor 12 and eccentric 25 is radially displaced from the center axis 16 of the engine shaft 13 by an eccentricity "e". The rotor 12 includes a pair of opposite outer side wall surfaces 30 and 31 which are adjacent and in slightly spaced relation to the inner surfaces of the housing sidewalls 14 and 15, respectively. As shown best in FIG. 1, side wall surfaces 30 and 31 are interconnected by a plurality of smooth epitrochoidal flank surfaces 32, 33 and 34 which intersect at apices 35, 36 and 37. The rotor further includes a rim 40 of varying thickness extending between the side walls to maintain the same in spaced relationship. A hub portion 42 of the rotor 12 also extends between the side wall surfaces 30 and 31. The interior surface of the hub portion 42 supports the bearing member 26 for rotation about the eccentric 25. As will be described in more detail below, a centrally located rotor cavity 45, defined by the rim 40, the hub 42 and the side walls 30 and 31, serves as a reservoir for cooling and lubricating fluid for the operative parts of the engine.

An external gear 46 is integrally formed with or fixed to the bearing housing 19 and is adapted to mesh with the teeth of an internal gear 47 fixed within the rotor 12. The external gear member 46 is concentric with the axis 16 and thus the crank shaft 13 while the internal gear 47 is concentric with respect to the axis 28. For the structure shown, where the housing 11 has two lobes and the rotor 12 has three apices, the tooth ratio between the gear 47 and the gear 46 is 3:2. It will be appreciated that epitrochoidal cavities of more lobes can be used, with rotors of more apices, and that the gear ratio will change accordingly.

As best illustrated in the preferred embodiment of FIG. 2 and the pictorial view of FIG. 3, the eccentric 25 includes a centrally positioned generally cylindrical section 48 integrally formed with or fastened to the shaft 13. The cylindrical section 48 is concentric with respect to the eccentric axis 28. Connected with each side of the center section 48 for rotation therewith is a steam or valve disc 49 and 52. In the preferred embodiment, the steam or valve discs 49 and 52 are securely fastened to the centrally positioned cylindrical section 48 by a plurality of threaded member or bolts 53. It is contemplated that one of the discs 49 or 52 could be integrally formed with the center section 48, but that the other would need to be capable of being removed from the section 48 to permit assembly of the rotor member 12 relative to the eccentric.

In the preferred embodiment, the inner side surface of the valve disc 49 is adapted for fixed engagement with one of the outer surfaces of the central cylindrical portion 48 by means of the bolts 53. The outer side surface of the disc 49 includes an annular steam cavity 56 and is adapted for sealing engagement via a first circular sealing element 54 with the inner surface of side wall 15 of the housing 11. The seal 54 which is carried by the disc 49 and extends within the outer side face of the disc 49 extends completely about the shaft 13 and is generally concentric with respect to the axis 16. As shown in FIG. 2, the seal 54 is disposed radially inwardly of the steam inlet 57 and steam cavity 56 to prevent the steam or other expansion fluid from leaking radially inward between the disc 49 and wall 15 in the area of the seal 54.

A second sealing member 65 shown best in FIG. 2 is disposed between an inner surface of the disc 49 and an outer surface of a portion of the rotor 12. In a preferred embodiment, the sealing member 65 is carried by a portion of the rotor 12, in particular a portion of the gear 47. The member 65 extends completely around the shaft 13 and is concentric with respect to the eccentric axis 28. The function of this seal is to prevent expansion fluid from entering the interior of the rotor cavity 45 and to prevent lubricating fluid from leaking into the steam passages.

A third sealing member is a circular face seal or working seal 55 carried by an outer surface of the valve disc 49 and extending completely about the shaft 13. The sealing element 55 is concentric with respect to the eccentric axis 28 and functions to control the passage of steam to the expansion chambers as described below.

The outer surface of the valve disc 49 also includes an annular groove or passageway 56 extending completely about the shaft 13. The annular passage 56 serves to direct the steam or other expansion fluid from the steam inlets 57, 57 to the working chambers of the expansion engine via the grooves 72(*a–c*) and 73(*a–c*). The seal members 54 and 65 function to keep the steam or other expansion fluid within the annular chamber 56 and to prevent the same from entering the interior of the rotor 12 and being exposed to the bearing members or the central shaft 13 and to otherwise keep separate the expansion fluid from the lubricating oil. Such seals also prevent the leakage of lubricating or cooling fluid from the interior of the rotor into the space between the disc 49 and side wall 15 and thus into the annular passage 56 and the expansion chambers.

The steam or valve disc 52 is fastened to the cylindricl center portion 48 and includes an annular steam cavity 61 and an outer surface carrying a first sealing member 59 for sealing engagement with the inner surface of the side wall 14. Similar to the seal member 54, the seal member 59 is positioned between an outer surface portion of the valve disc 52 and the inner surface of the wall 14 and is concentric with the center axis 16 of the shaft 13.

A second sealing member 64 is associated with the disc 52 and is carried by an outer surface of the rotor 12 and contacts an inner surface of the disc 52. Similar to the member 65, the seal 64 is concentric with respect to the eccentric axis 28 and prevents steam or other expansion fluid from entering the rotor cavity 45 as well as preventing lubricating fluid from leaking into the steam passages and expansion chambers.

A third sealing member comprising the circular face or working seal 60 is also carried by an outer surface of the disc 52 and is adapted for sealing engagement with the side wall 14. Similar to the seal 55, the seal 60 functions to control the passage of steam to the expansion chambers. The annular groove 61 is formed in the outer surface of the valve disc 52 between the seal members 59 and 60 to provide a passage for the steam or other expansion fluid from the steam inlets 63, 63 to the working chambers of the expansion engine.

In the preferred embodiment the seal members 54 and 59 are intended to be generally concentric with the center axis 16 while the seal members 55, 60, 64 and 65 are intended to be generally concentric with the center line 28 of the eccentric 25. It is permissible, however, if these seals are slightly eccentric with respect to the above axes to improve the wiping action and lubrication of the seals.

The improved means for lubricating the operative parts of the expansion engine and providing cooling fluid thereto includes a centrally disposed lubrication duct or tap hole 66 extending within the interior of the shaft 13 along the axial center line 16. Also included are a plurality of radially disposed lubrication ducts or tap holes 67, 68 and 69 providing communication between the central duct 66 and the sleeve bearings 51, 50 and 26, respectively. By providing sufficient oil or other lubrication to the central duct 66, oil or other lubricating fluid is allowed to flow through the radial passageways 67, 68, 69 to the sleeve bearings and is then allowed to leak past the sleeve bearings into the interior cavity 45 of the rotor 12 and to the gear members 46 and 47. Thus, the engine of the present invention includes means for maintaining sufficient lubrication to all of the operative parts of the engine. As described above, the circular seal members 64 and 65 prevent the lubricating fluid from leaking out of the cavity 45 into the expansion chambers or the steam passageways. Similarly, the seal members 54 and 59 prevent the oil or other lubricating fluid from leaking into the annular cavities 56 and 61. In the preferred embodiment, a further lubrication tap hole 70 and 71 is formed in the bearing insert 19 and the side wall 14, respectively to allow lubricating oil within the system to flow through the system and exit through the passages 70 and 71 to an appropriate reservoir or oil sump (not shown). This allows for a continuous flow of lubricating or cooling oil.

Figure 4:
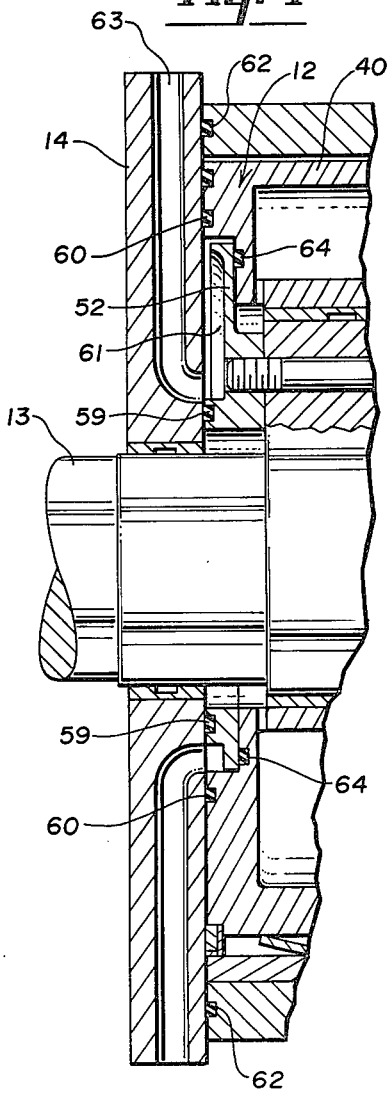
FIG. 4 is a sectional view showing an alternate embodiment of the steam or valve disc sections of the eccentric element.

As illustrated in FIG. 2, the working seals 55 and 60 are illustrated as being disposed between a portion of the valve discs 49 and 52 and their respective housing sidewalls 15 and 14. However, as shown in the alternate embodiment of FIG. 4, the working seals 55 and 60 can also be carried directly by the rotor 12.

In operation, the eccentric 25 and the gears 46 and 47 combine to limit the movement of the rotor 12 in the housing 11 to a combination of rotation about the axis 27 and revolution about the axis 16. Such movement of the rotor 12 is defined in the present application as planetating movement. Each of the apices 35, 36 and 37 define the location of lines of sealing contact between the rotor 12 and the housing 11 and may be provided with suitable apex seal blades 72, 73 and 74. Rotor flanks 32, 33 and 34 and the housing lobes 21 and 22 combine to define a plurality of working chambers 75, 76 and 77 which move about the axis 16 with movement of the flank surfaces 32, 33 and 34, respectively, decreasing and increasing in volume cyclically as they do so. In operation of the expansion engine of the present invention, a pressure fluid such as steam is supplied to the annular grooves 56 and 61 in the sides of the steam discs 49 and 52 from a source such as a steam boiler, not shown. Such fluid is provided through the steam supply conduits 57 and 63 in the sidewalls 15 and 14, respectively.

As shown best in FIG. 1, the inner surface of the side walls 14 and 15 in each of the lobe areas 21 and 22 is provided with expansion fluid passage means comprising a plurality of grooves 72a, 72b and 72c extending generally radially from the axis 16 toward the outer peripheral wall 17 of the housing. The purpose and location of these passage means is to conduct the expansion fluid from the annular grooves 56 and 61 (FIG. 2) to the working chambers 75, 76 and 77, at appropriate times to cause the desired motion of the rotor 12 by pressure on an appropriate flank 32, 33 or 34. Further fluid passage means 78 and 79 are provided in the wall 14 at locations near the lobe junctions 23 and 24. The purpose of these passages 78 and 79 is to provide for exit of the pressure fluid from the cavity lobes 21 and 22 at appropriate times. For this purpose, they are connected through the aperatures 82 and 83 and the conduits 80 and 81 to an exhaust connection, not shown. Such exhaust connection may be a condensor for reducing the exhaust steam to water and returning it to the boiler.

The general operation of the rotary expansion engine of the present invention is conventional and is similar to that described in U.S. Pat. No. 4,047,856.

While the description of the preferred embodiment of the invention has been quite specific, it is contemplated that various changes and other modifications could be made without deviating from the spirit of the present invention. Accordingly, it is intended that the scope of the present invention be dictated by the appended claims rather than by the description of the preferred embodiment.

I claim:

1. A rotary expansion power unit including a housing having opposite end walls spaced apart along a first axis by a peripheral wall shaped to define an epitrochoidal cavity symmetrical about said first axis, a rotor symmetrical about a second axis, parallel to said first axis, and movable in said cavity in sealing relationship to define a plurality of working chambers, crankshaft means, having an eccentric member on which said rotor rotates on said second axis eccentrically with respect to said first axis, for limiting motion of said rotor in said cavity to planetating movement about said first axis, and means for conducting and controlling expansion fluid flow into and from said working chambers comprising:

at least one valve disc secured to a corresponding side face of said eccentric member and extending between a corresponding said end wall and said rotor, said at least one valve disc defining an annular disc cavity facing said corresponding end wall, supply passage means for directing a continuous flow of expansion fluid to said disc cavity, bridging passage means in the inner surface of said corresponding end wall to conduct expansion fluid from said disc cavity to said working chambers during first predetermined portions of rotor movement, and exhaust passage means for affording egress of expansion fluid from said working chambers during second predetermined portions of rotor movement.

2. The rotary expansion unit of claim 1, wherein said at least one valve disc lies inset within the side profile of said rotor.

3. The rotary expansion unit of claim 1, wherein there are two valve discs on opposite sides of said rotor and associated supply passage means and bridging passage means for each valve disc.

4. The rotary expansion unit of claim 1, wherein said disc cavity is of varying radial height annularly along said at least one valve disc.

5. The rotary expansion unit of claim 1, further comprising a first seal means disposed between said rotor and said at least one valve disc and a second seal means disposed between said at least one valve disc and said corresponding end wall.

6. The rotary expansion unit of claim 5, wherein said second seal means comprises inner and outer seal rings for sealing radially beneath and above said disc cavity, respectively.

7. The rotary expansion power unit of claim 1 including means for providing cooling fluid to the interior of said rotor.

8. The rotary expansion power unit of claim 7 wherein said means for providing cooling fluid to the interior of said rotor includes tap holes extending axially through said crankshaft and radially outwardly to the interior of said rotor.

9. A rotary expansion power unit including a housing having opposite end walls spaced apart along a first axis by a peripheral wall shaped to define an epitrochoidal cavity symmetrical about said first axis, a rotor symmetrical about a second axis, parallel to said first axis, and movable in said cavity in sealing relationship to define a plurality of working chambers, crankshaft means, having an eccentric member on which said rotor rotates on said second axis eccentrically with respect to said first axis, for limiting motion of said rotor in said cavity to planetating movement about said first axis, and means for conducting and controlling expansion fluid flow into and from said working chambers comprising:

at least one valve disc secured to a corresponding side face of said eccentric member and extending between a corresponding said end wall and said rotor, said at least one valve disc having eccentrically arranged inner and outer side face seal means defining therebetween a disc cavity facing said corresponding end wall, supply passage means for directing a continuous flow of expansion fluid to said disc cavity, bridging passage means in the inner surface of said corresponding end wall to conduct expansion fluid from said disc cavity to said working chambers during first predetermined portions of rotor movement, and exhaust passage means for affording egress of expansion fluid from said working chambers during second predetermined portions of rotor movement.

10. The rotary expansion unit of claim 9, wherein said at least one valve disc lies inset within the side profile of said rotor.

11. The rotary expansion unit of claim 9, wherein there are two valve discs on opposite sides of said rotor and associated supply passage means and bridging passage means for each valve disc.

12. The rotary expansion unit of claim 9, wherein said inner and outer side face seal means are in the form of eccentrically arranged seal rings.

13. The rotary expansion unit of claim 12, wherein said inner side face seal means is generally concentric with said first axis and said outer side face seal means is generally concentric with said second axis.

* * * * *